US008938939B2

(12) United States Patent
Roche

(10) Patent No.: US 8,938,939 B2
(45) Date of Patent: Jan. 27, 2015

(54) DISPENSING APPARATUS

(76) Inventor: Glenn Roche, Notting Hill (AU)

( * ) Notice: Subject to any disclaimer, the term of this patent is extended or adjusted under 35 U.S.C. 154(b) by 196 days.

(21) Appl. No.: 13/318,990

(22) PCT Filed: May 7, 2010

(86) PCT No.: PCT/AU2010/000555

§ 371 (c)(1),
(2), (4) Date: Nov. 7, 2011

(87) PCT Pub. No.: WO2010/127412

PCT Pub. Date: Nov. 11, 2010

(65) Prior Publication Data

US 2012/0042615 A1 Feb. 23, 2012

(30) Foreign Application Priority Data

May 8, 2009 (AU) ..... 2009902017

(51) Int. Cl.
*B65B 13/04* (2006.01)
*B65B 13/22* (2006.01)

(52) U.S. Cl.
USPC ..... 53/588; 53/218; 53/203; 53/580; 53/390; 493/475

(58) Field of Classification Search
CPC ..... B65B 13/04; B65B 13/22
USPC ..... 53/467, 399, 441, 465, 588, 556, 210, 53/389.3, 390, 475, 218, 203; 414/799
See application file for complete search history.

(56) References Cited

U.S. PATENT DOCUMENTS

| | | | | |
|---|---|---|---|---|
| 3,495,375 | A | 2/1970 | Burhop et al. | |
| 4,067,174 | A * | 1/1978 | Goldstein | 53/556 |
| 4,095,395 | A | 6/1978 | Goldstein | |
| 4,209,961 | A | 7/1980 | Donnelley | |
| 4,369,614 | A | 1/1983 | Tetzner | |
| 5,092,109 | A * | 3/1992 | Maki-Rahkola et al. | 53/587 |
| 6,526,734 | B1 | 3/2003 | Huson et al. | |
| 6,742,322 | B2 * | 6/2004 | Qicang | 53/588 |
| 6,991,195 | B2 * | 1/2006 | Mazzarolo | 242/557 |
| 7,051,492 | B2 | 5/2006 | Huson | |
| 2007/0095026 | A1 | 5/2007 | Moser et al. | |

FOREIGN PATENT DOCUMENTS

FR 2727075 A1 5/1996

OTHER PUBLICATIONS

FR 2,727,075 (EPO Machine Translation).*
FR 2,727,075 (EPO Machine Translation) Nov. 21, 1994.*
International Search Report for PCT/AU2010/000555, Completed by the Australian Patent Office on Jun. 25, 2010, 3 Pages.

* cited by examiner

*Primary Examiner* — Christopher Harmon
(74) *Attorney, Agent, or Firm* — Brooks Kushman P.C.

(57) ABSTRACT

A trolley apparatus for dispensing plastic stretch wrap film from a roll suitable for wrapping a pallet of stacked loose goods, characterized by a transportable frame structure having wheels or castors to provide support and mobility, the frame having a means of adjusting the height of the roll, the frame is provided with a guide roller positioned for use as a fulcrum point for generating tension in the stretch wrap film, and, a cutter for detaching the stretch wrap film at the completion of the operation, the end of the stretch wrap film being retained for next use.

35 Claims, 9 Drawing Sheets

Figure 1:
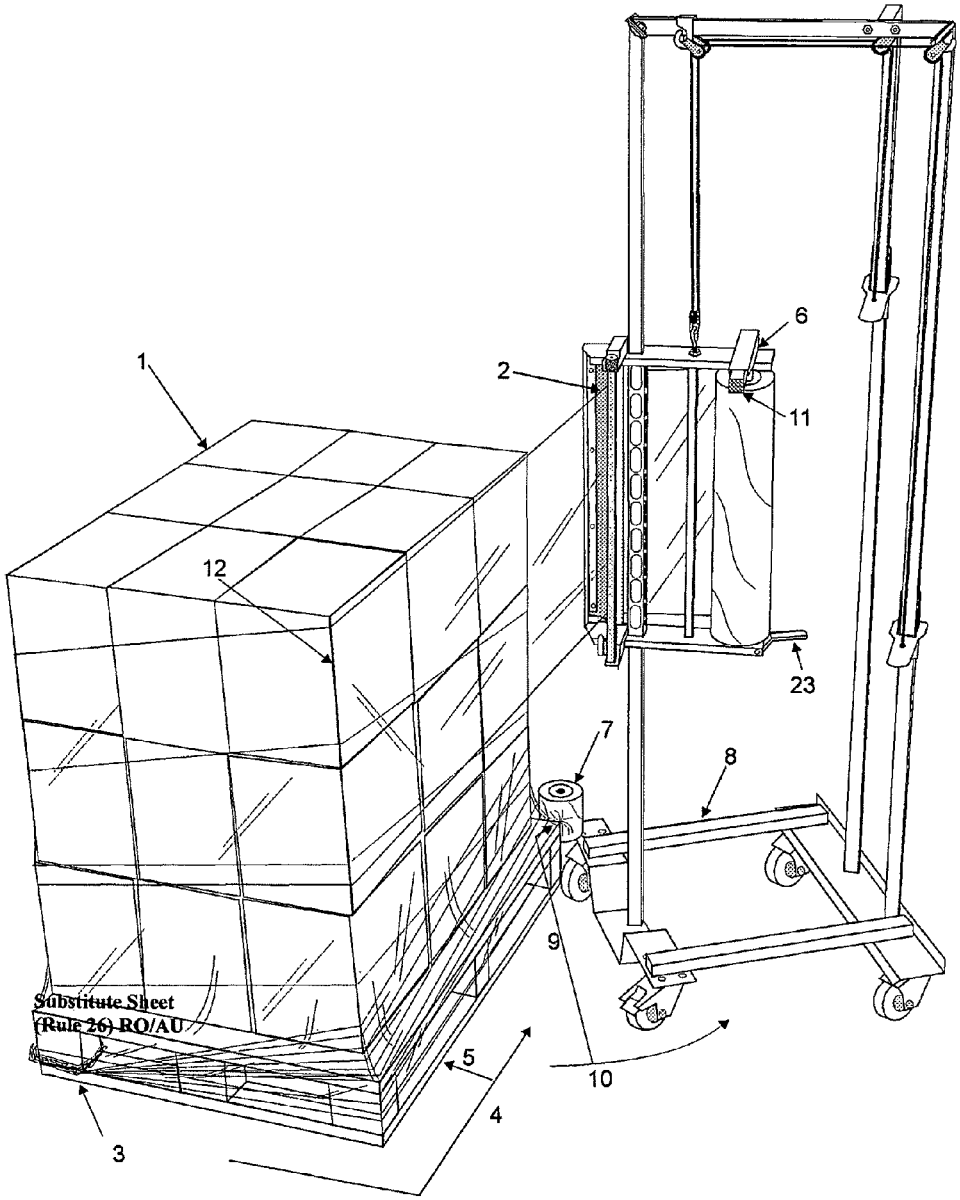

Substitute Sheet
(Rule 26) RO/AU

Fig: 2.1
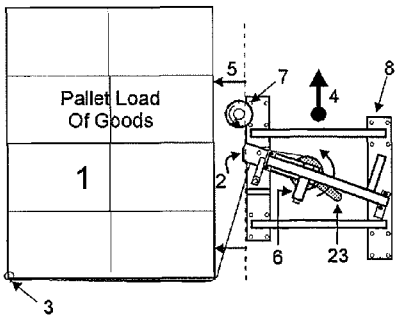
Fig: 2.2
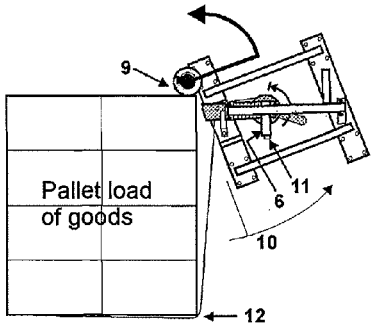
Fig: 2.3
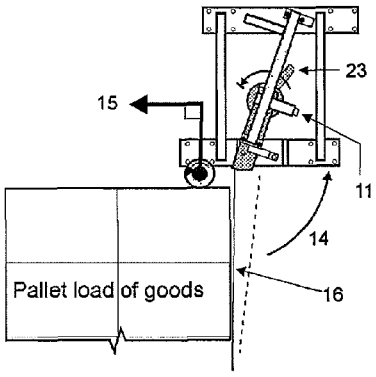
Fig: 2.4
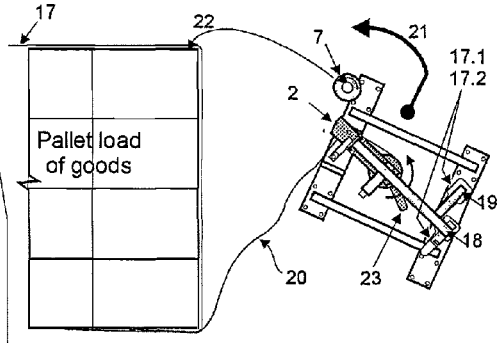
Fig: 2.5
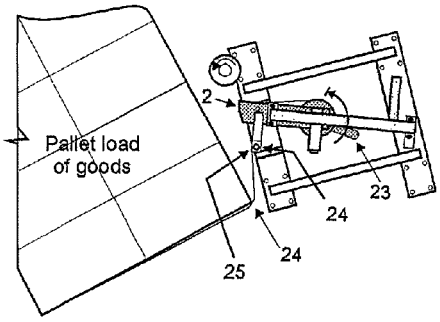
Fig: 2.6
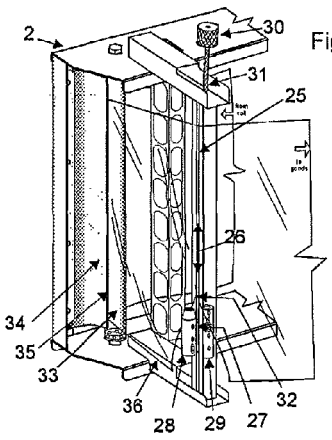

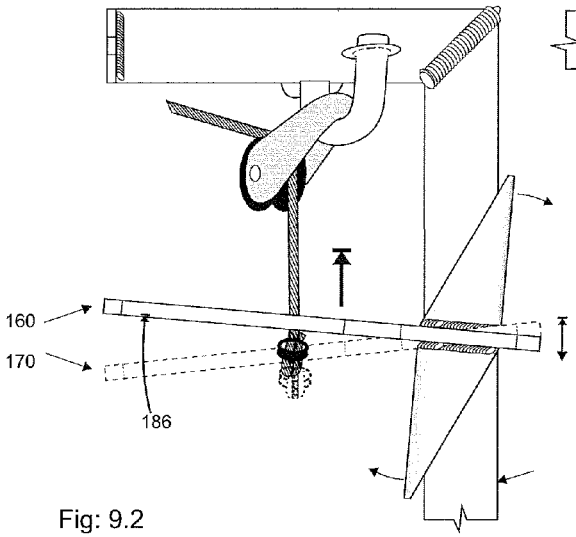
Fig: 9.2
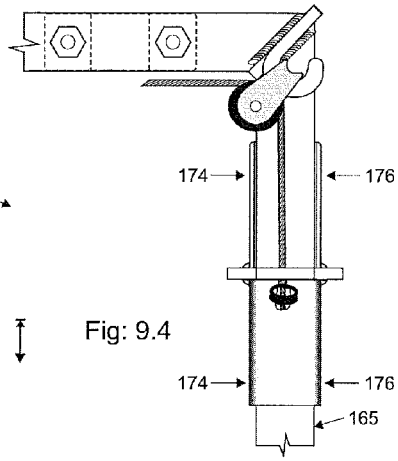
Fig: 9.4
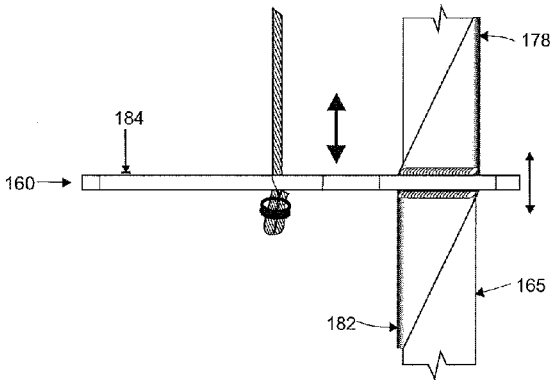
Fig: 9.3
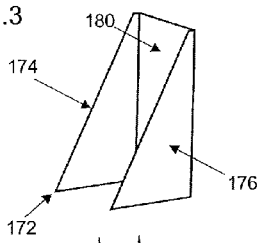
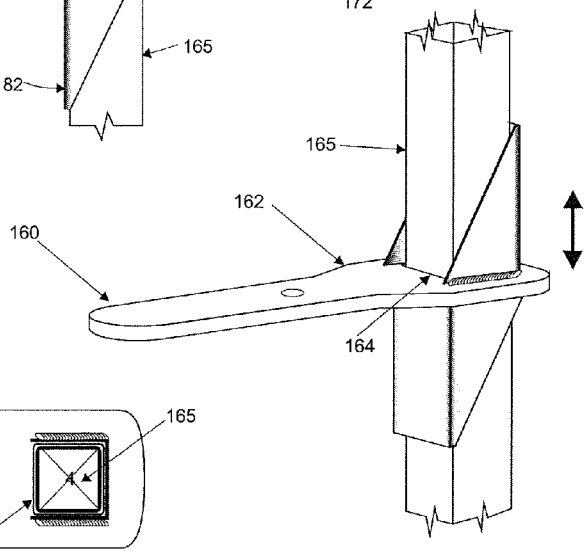
Fig: 9.1
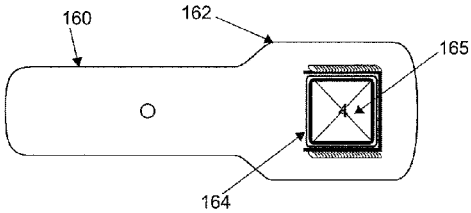

DISPENSING APPARATUS

An apparatus is disclosed as a means to dispense and tension plastic stretch film to encircle and tether goods placed on the ground or on top of a common transportation pallet.

The common transportation pallet can be made of plastic or wood for goods to be placed on top of prior to being picked up by a pallet jack or forklift and lifted onto shelving for storage or a truck bed for transport. Pallets have openings for fork lift tines to enter which also provide a place for the stretch film being referred to in this description to be tied to the pallet.

This is a typical pallet and all reference from hereon will be made to this style of pallet.

Goods produced in many factories around the world require containment or protection during storage or transportation that is effectively performed by plastic film being stretched around the goods and tethered. Dispensing and stretching the plastic film to encase the goods can be achieved by manual and mechanically assisted means.

Goods that are commonly stacked in cartons, bundles or bags that are to be held together to form a singular mass to avoid spillage during storage or transport can be protected from weather, theft or view by being wrapped in either clear film that is most common or coloured or black wrapping film that is also resistant to UV light to further protect goods in transit or storage.

There are several ways in which the film can be wrapped around goods.

One way to apply the wrap film is manually, a description follows.

After first drawing sufficient film from a roll of film to attach by tying the film end to the pallet or jamming the end under the goods to be wrapped, the wrapping film roll is carried by its tubular cardboard core that the supplied film is rolled onto by inserting one's fingers into each open end of the cardboard core and carrying the roll in a vertically upright manner, horizontally around the goods to allow the film to be drawn from the roll in front of you as you proceed in a backwards walking direction.

To commence this wrapping procedure after tying the film onto the pallet one has to bend down to ground level so the lower edge of the film overlaps the bottom of the goods and the top edge of the pallet onto which the goods are placed for transport. The film is to be stretched to hug the goods into a tight single body of goods, this requires the film to be stopped or restricted from being drawn off of the roll in a manual manner by squeezing the film roll and core with one's hands while still walking backwards while bent over to stretch the film around each corner of the pallet and goods.

Once the film has come into contact with the goods at each corner of the pallet, the film is allowed to be drawn off of the roll by releasing the grip of the hands on the film roll core as progress is made toward the next corner.

This backwards walking, encircling of the pallet and goods with the wrapping film' continues with a gradual increase in wrapping height until it has covered the goods from bottom to top at which point the film is ripped, sliced with a knife or punctured with a pointed hand to separate the wrapping film from the roll from which it has been drawn.

Common risks associated to the manual wrapping task is back strain due to the combination of carrying the weight of the wrapping film roll, prolonged bending down to begin and progress wrapping at ground level, strained backs from twisting the torso to stretch the film, burnt fingers and hands from the friction generated from handling the rapidly unwinding roll core, overhead lifting strain by wrapping to potentially over head height, wrist strain from trying to tear through the ever stronger bunching wrapping film to separate it at wraps end or knife cuts when a slashing action is required with no support for the film to cut the roll free from the finished wrapped goods.

Articles to facilitate the manual wrapping of goods with said. stretch film take the form of a handle upon which the wrap roll cardboard core is placed which can include an arrangement of thrust bearing, pressure spring or tapered end plug, a base plate or frame and a long threaded rod passing through said cardboard core is assembled that also provides two handle grips to carry the assembly with marginally increased ease though heavier in combination.

The shortcomings of the above described handle arrangement is the many losable parts, some if retained require lubrication, the assumption that all goods being wrapped with the device will require the same tension applied as a result of the unrolling friction applied, the unease of trying to draw the film from the roll to commence the wrapping task when the friction is of constant resistance as well as the whole assembly weight needing to be carried from ground level to overhead height regardless of the convenience provided by its hand grips.

The back ache from bending down to ground level and carrying the device is the same or more as is experienced with carrying the roll by itself and still it does not provide any means to cut the film at the end of the wrapping procedure nor retain the cut end of the film from adhering back onto the roll which is very difficult to find and then peel uniformly from the roll due to its thin and sticky properties.

Another means to wrap goods with stretch film is an automated machine which includes a turntable commonly requiring a motorised means to propel the turntable, a dispensing carriage that is sometimes motorised to release the film in a slowed manner and a pedestal with a bearing track on which the dispensing carriage is raised and lowered commonly by a motor also, particularly as a heavier, larger diameter roll of film is routinely used on an automated wrapping machine. These rolls of film are unable to be carried in a manual wrapping scenario as they are too heavy.

To perform a wrapping procedure with an automated machine the goods are first placed on top of a transportation pallet at a loading location, the pallet containing the goods is then picked up, driven to and then set onto the turntable of the automated wrapping machine by a forklift. The wrap film end is drawn off of the roll of film that is mounted in the dispensing carriage of the machine and is then tied to the pallet.

To perform a wrapping procedure with an automated machine the goods are first placed on top of a transportation pallet at a loading location, the pallet containing the goods is then picked up, driven to and then set onto the turntable of the automated wrapping machine by a forklift. The wrap film end is drawn off of the roll of film that is mounted in the dispensing carriage of the machine and is then tied to the pallet.

The machine is set in motion from a switch panel controlled by the operator and as the turntable turns, drawing the film off of the roll, the dispensing carriage ascends until the top of the goods have been reached and possibly overlapped at which time the dispensing carriage is lowered down along the pedestal by a height controlling motor. The operator then needs a knife to slash through the film to finish the wrapping procedure. However, the wrapped pallet again needs to be lifted from the turntable and taken away to a storage location by the forklift.

In order to delineate the provided invention function from the forklift and turntable means of pallet wrapping, the following description are the steps a trained forklift driver has to perform to complete wrapping a pallet with an automated wrapping machine.

Typically a forklift could do as many as eight trips to wrap a pallet with said machine. They are:

Operator walks to and mounts the forklift,

Forklift is driven forward to lift the pallet,

Reverser to withdraw the pallet from a place at which it was loaded,

Forward and possibly drives distance to place the pallet onto the turntable,

Reverses forklift to withdraw the fork tines from the pallet and clear of the turntable, The operator dismounts the forklift and walks to the wrapping machine to perform the wrapping of the pallet, The operator walks back to and mounts the forklift, Forward drives the forklift to lift the pallet up from the machine turntable, Reverses the forklift to clear the turntable, Forward drives the forklift taking the goods to the place of storage, Reverses the forklift clear of the pallet either stored or placed onto a waiting truck, The driver stops the forklift, dismounts and walks away.

So inefficient is the routine of loading and unloading an automated machine, it is effectively engaging tons of heavy lifting and rotation equipment to train substantially weightless plastic film around the load.

Also it takes a more costly, trained and qualified forklift operator to drive pallets of goods to and from the wrapping machine in most industrialised places of employment.

The action associated to constantly forklift drive pallets to and from motorized wrapping machines must be factored into the future cost of implementing such equipment.

The floor and forklift approach space, designated to operating an. immobile turntable based machine is another prohibitive factor of this type of equipment being installed.

Another means to wrap a pallet of goods with stretch film is by a robot wrapping machine.

This is a battery powered device that is motorised for driving itself around a pallet of goods, raising and lowering its wrap film dispensing carriage, tensioning the wrap film dispensed via restricted release rate and possibly parking itself in a nearby bay away from the pallet.

The expensive machine relies on heavy assemblies to keep it upright which is a by product of onboard stored batteries, motors and its chassis.

It has limited top heavy wrapping height due to a relatively small footprint to save on space, it possesses belt driven guidance means that rub and tractor along the side of a pallet to be wrapped and employs electronic sensors to approach and encircle the pallet while raising and lowering the dispenser carriage to complete the wrapping task.

It also requires a lock out safety barrier system to avoid ankle crushing or fatal body crushing injuries if approached during a set wrapping command by any operator.

No means of tension regulation relative to the load staying in place or being dragged off exists and so its applicability is limited to a predictable load of consistent weight.

The robot wrapping means takes up designated floor space, is reliant on specific operation and safety training, does not wrap to some greater heights and may still require a forklift to place the pallet in the wrapping area however the pallet could also be wheeled into position with a manual pallet jack trolley.

Alternatively in the 1990s there was observed a trolley based apparatus that was presented to a business for sale that carried a machine roll of wrap film, it hoisted the extra weight by winch, had many losable parts and was very large. This apparatus required the winch to be slowly wound up to increase the wrap height, the winch was too slowly unwound to lower the roll or in the case demonstrated, the winch ratchet 'dog' was released causing the rapidly unwinding handle to fly around and hit the operator in the wrist very hard, the winch cable was frayed causing hand injuries from fine wire strands, tile tension was constant and so was too firm to draw the wrap film to begin without tearing and was too loose to fully 'contain and tether goods to a satisfying degree. The tripod wheel arrangement was unstable when wrapping at height and the device was too heavy to transport in anything other than a truck. The device was not seen again for sale by the time this description was written.

The examples explained are expensive, inefficient and dangerous methods of wrapping goods that have prevented small to medium businesses changing from the hand lifting, carrying and tensioning of wrapping film of the manual wrapping task that has prevailed.

The Provided Invention

The provided invention is a lightweight trolley based apparatus that is comprehensive of all functions to execute the wrapping of goods with stretch film whether the goods are placed on a pallet or in the case of larger products or equipment, sitting on the ground.

The provided invention is an apparatus that avoids the handling shortcomings of manual wrapping methods as well as avoiding the costly, space prohibitive and dangerous methods of automated or partially motorised wrapping machines described previously.

The provided invention executes all of its functions with passive mechanisms. There are no motors, springs, counter balances or losable parts to complicate its use.

To perform a wrapping procedure with the provided invention, it is conveniently wheeled to the pallet where the pallet sits. This could be at the end of a production line or in a queue of several pallets waiting to be wrapped.

The apparatus consists of a rolling base, a frame upon which there is a wrap film dispensing carriage and control interfaces to execute control of its operable functions.

The base is fabricated to affix wheels underneath and the three apparatus frame tubes and a guide roller above. The guide roller is mounted on the front or leading left corner of the base for its prescribed direction of travel. The method of guidance could also take the shape of a curved, sliding buffer rail.

The apparatus can be pushed and steered towards the location of use by the main control handle which sits upon the top of the wrap film dispensing carriage that can be raised or lowered upon the apparatus with either of two height control handles to ergonomically suit the operator.

The height controls can then facilitate lowering the dispenser carriage to its lowest setting to begin wrapping the pallet of goods from the ground level upon which the pallet' is commonly placed. At times pallets are placed upon other pallets for the benefit of the person loading so they do not have to bend down to almost ground level to load the goods onto the pallet or so that the person wrapping the goods does not have to bend down to ground level to commence wrapping. The provided invention can be used at ground or raised level to commence the wrapping task.

All reference will now be made to a pallet loaded with goods that is placed on the same ground as the operator stands and upon which the apparatus is to be wheeled.

When the dispensing carriage is set at its lowest height, a length of plastic wrap film is drawn from the roll through the dispensing carriage roller and rubber strip film end-keeper with enough length to tie the wrap film around one corner of the pallet.

In a forward walking manner with the pallet on the operator's left, the apparatus is pushed parallel to the side of and toward the next corner of the pallet.

The apparatus possesses a horizontally rolling soft guide roller mounted forward left on the rolling base at the height of the pallet edge that can roll against the side of the pallet as guidance while being non-damaging to goods that may' overhang the pallet.

The guide roller is aimed toward and steered closely around the next corner of the pallet by the control handle of the apparatus at which time forward travel is paused.

The control handle on the apparatus dispensing carriage incorporates a brake prong below and a pivoting brake lever handle and brake prong respectively within. The two brake prongs descend into the wrap roll cardboard core below the control handle and when operated, expand inside said cardboard core which stops or slows the film from unrolling.

The apparatus is then pushed forward, pivoting around the stationary guide roller at the pallet's corner.

This generates leverage and subsequent tension in the wrap between the tied fastening of the wrap to the pallet and the now pulling apparatus with the wrap film stretching audibly.

Once the apparatus is pivoted around the guide roller approximately 90 degrees it can be pushed forward along the next side of the pallet which immediately causes the wrap film to touch the goods along the first side of the pallet.

The thin film becomes adhered to the goods due to its stretching, clinging nature. At this time the wrap roll brake handle can be released allowing progress of the apparatus toward the next corner of the pallet and subsequent drawing of wrap film from the unrolling film core to repeat the tensioning process.

Once the first or second revolution of wrap film has encircled the pallet, the dispensing carriage is raised upon the apparatus by either of two height control handles. The height of the subsequent wrap revolutions and the resultant wrap overlap is determined by the operator judging the weight of the goods being wrapped and its required retention strength. More Wrap overlap for heavier goods and less wrap overlap for lighter goods.

When raising or lowering the height at which the wrap film is dispensed to cover from ground level to overhead height, the operator of the provided invention does not lift the full weight of the wrap roll as a result of the 2:1 ratio of each height control handle sharing the weight of the dispensing carriage via the doubled back lifting cable.

Instead of lifting the weight of the wrap roll 100% of the time in a manual wrapping procedure the provided invention requires half the weight being lifted for one seconds worth of time during each revolution of the pallet.

The same progress as is performed from the beginning is now performed with the apparatus dispensing carriage at an increased height and further increased height positions until the top of the goods have been reached or overlapped as the encircling, elevating wrapping spiral progresses.

At this point the wrap revolutions can if required be continued in a downward encircling manner by lowering the dispenser carriage upon the apparatus frame as progress around the pallet is continued. This is usually done when goods are extremely heavy or slippery bags for example would easily slide off of each other during transit within insubstantial wrap.

The leverage afforded by the apparatus of the provided invention can be exploited to tension the film around the goods as a means to avoid pulling and twisting of the human torso and subsequent back strain commonly associated with backwards walking manual wrapping task. If however there is no place to gain the prescribed point of leverage to attain the wrap film tension then merely leaning forward and applying the wrap roll brake will afford significant tension with a more ergonomically acceptable non-lifting, forward walking effort before changing direction and encircling the goods being wrapped with" the tensioned film.

At wraps end, the dispensing carriage includes a cutter that slices through the wrap film to allow the apparatus to move away and onto the next pallet to be wrapped.

One end of the film that is sliced by the cutter, naturally fails against and adheres to the wrapped pallet load of goods, the other would cling back onto the film roll if the roll was being held by hand but to avoid the time wasted retrieving the end of the film clinging back onto the roll, the apparatus possesses a wrap end keeper.

Positioned approximately 125 mm away from the apparatus wrap cutter, the wrap end keeper is a pinch point that is the result of a 50 mm or suitably wide rubber strip fastened from top to bottom of the dispensing carriage corner brace the right hand edge of said rubber strip touches the vertical wrap width roller upon the dispensing carriage where against and around said roller the wrap film exits the dispensing carriage.

This retains the end of approximately 125 mm of the wrap film to easily be held and drawn off of the roll to commence another wrapping task.

For ease of reference all following description of the provided invention apparatus and its function will accompany illustrations in numbered form.

All left and right reference will be made as viewed from an advised position of apparatus operation thus a description of 'forward', is furthest from position of operation as the apparatus is to pushed from behind.

LIST OF DRAWINGS

FIG. 1 Isometric view of the invention apparatus beside a pallet to be wrapped.

FIG. 1, & FIG. 2.1. Share the numbered references.

FIG. 2.1, 0.2, 0.3, 0.4, 0.5, 0.6. Continues from FIG. 1 with progress now viewed from above.

Figure 3:
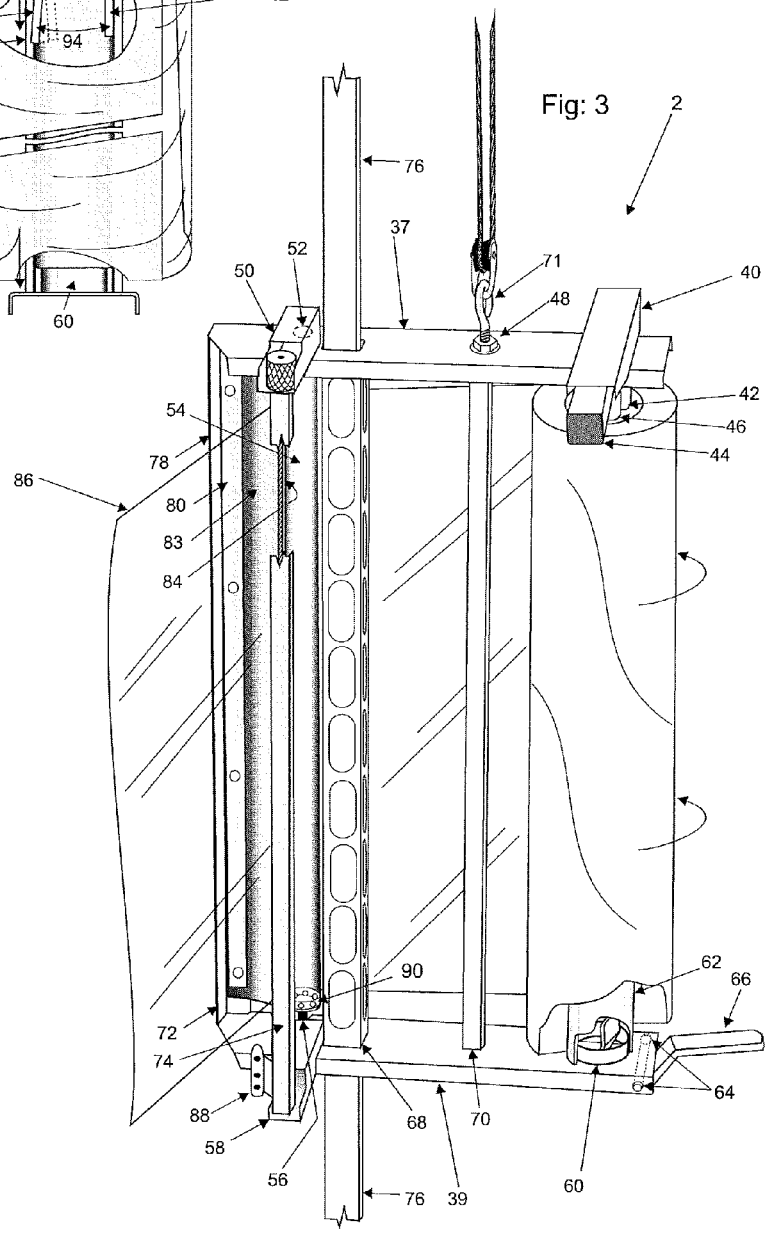

FIG. 3 Assembly and Functions of Apparatus Dispensing Carriage/Upper Wrap Roll Brake/End Keeper and Lower Brake Handle.

Figure 4:
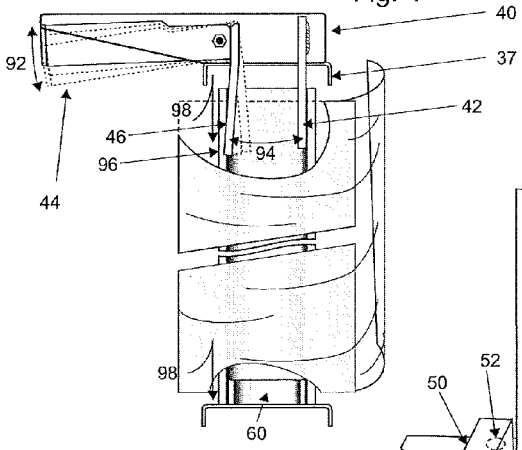

FIG. 4 Apparatus Upper Wrap Roll Brake Handle.

Figure 5:
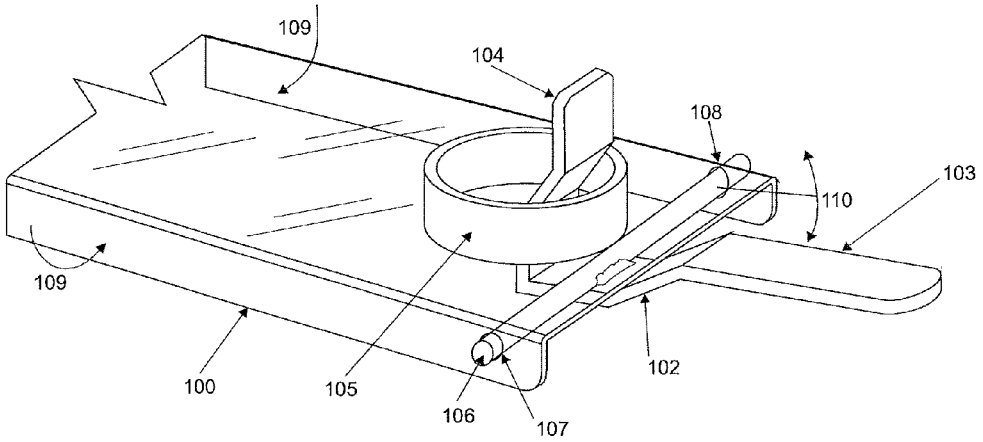

25 FIG. 5 Apparatus Lower Wrap Roll Brake Handle.

Figure 6:
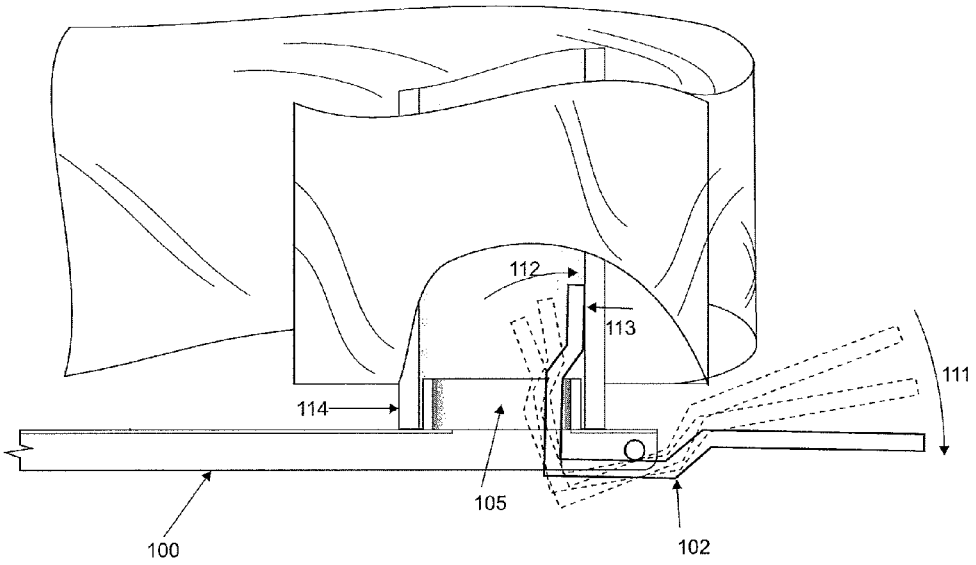
Figure 7:
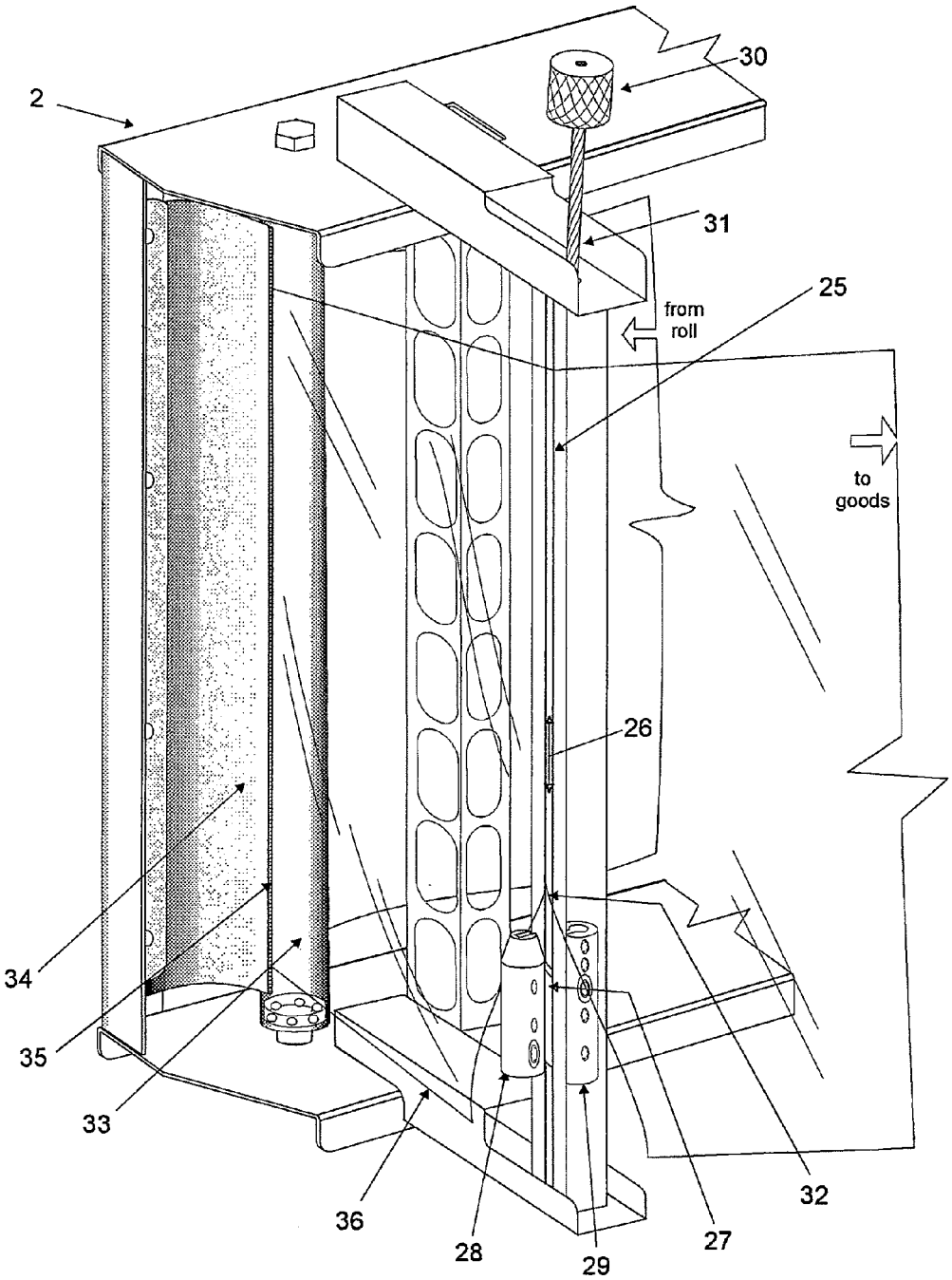

FIG. 6 Apparatus Lower Wrap Roll Brake Handle Operation:

FIG. 7. Apparatus Wrap Film Cutter and Wrap Film End Keeper.

Figure 8:
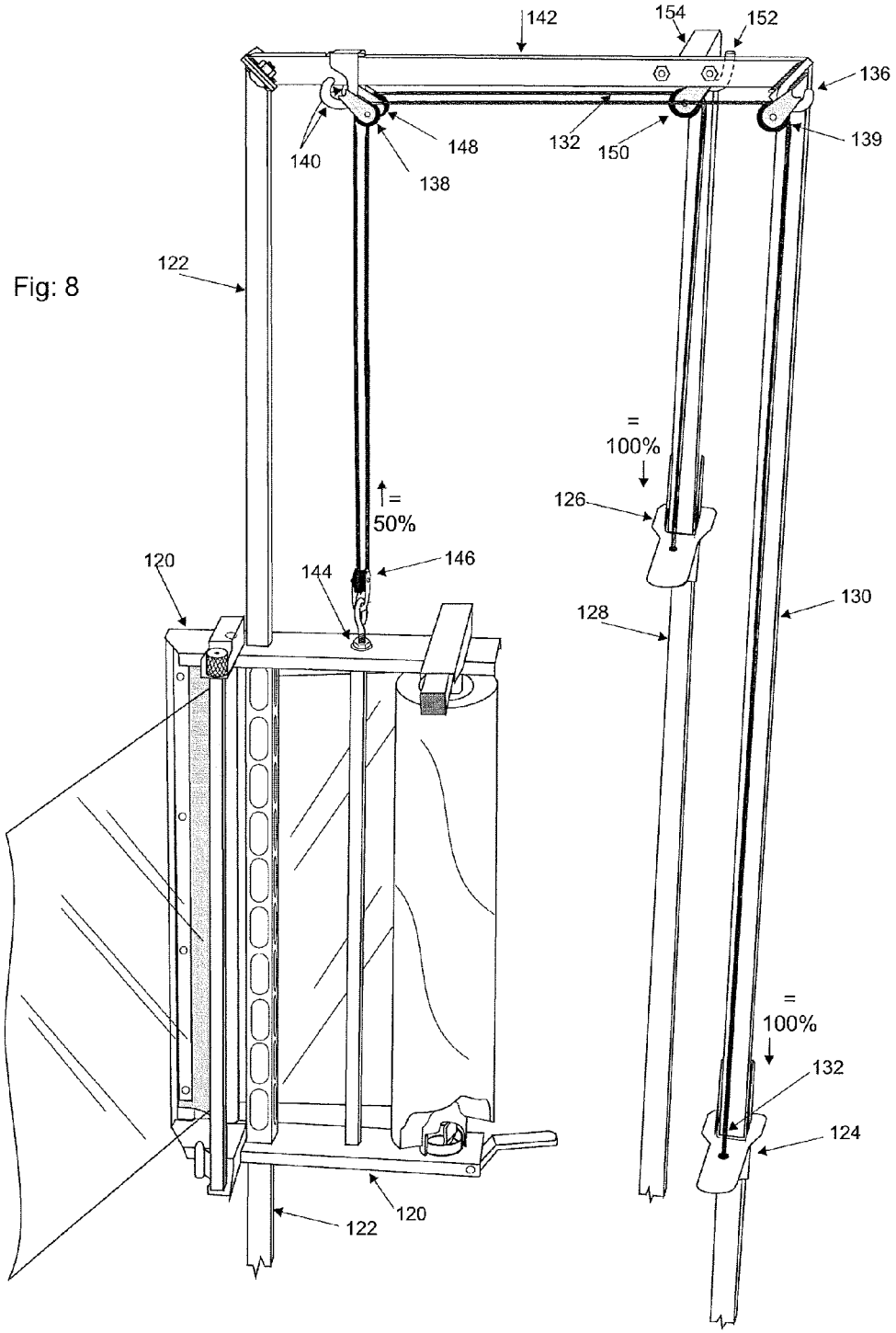

FIG. 8 Apparatus Height Control Handles and Lifting Cable.

Figure 10:
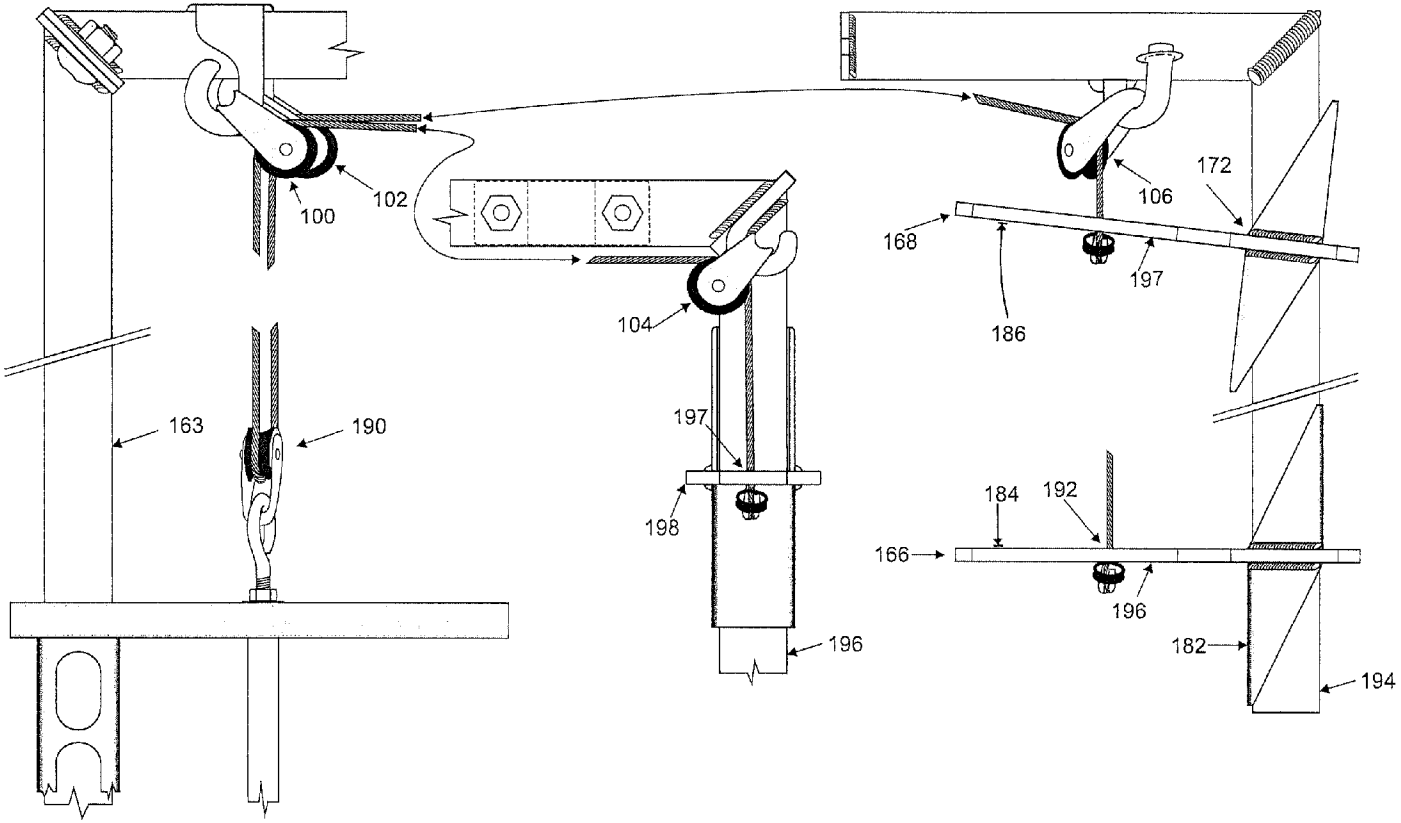

FIG. 9.1, 9.2, 9.3, 9.4 Apparatus height control handles position lock and release:

FIG. 10 Apparatus lifting Cable and operation of locking height control handles.

Figure 11:
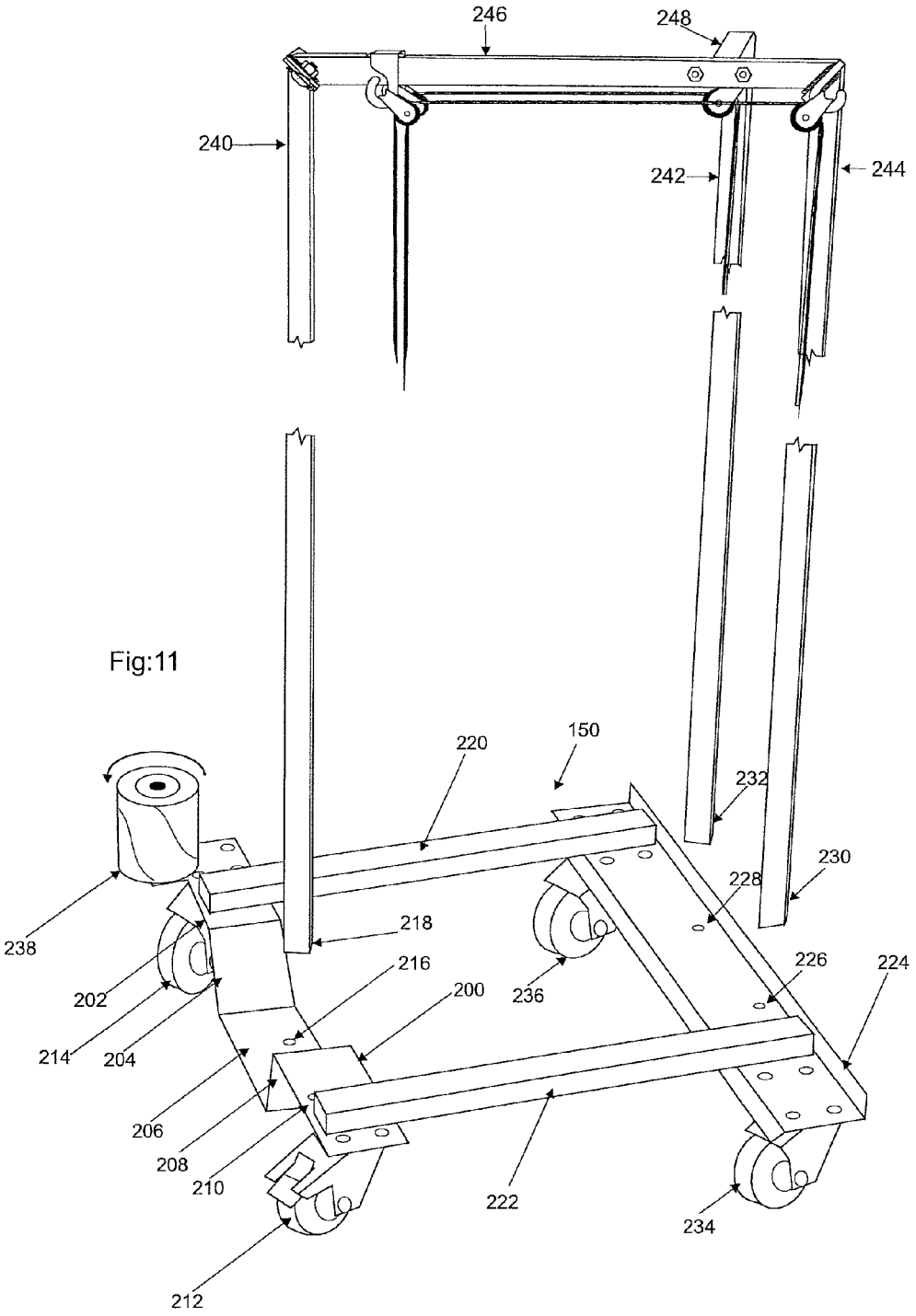

FIG. 11 Apparatus base and Frame.

The following is a description of the wrapping process from beginning to end using the provided invention apparatus.

It is described across drawings FIG. 1 and FIGS. 2.1-2.6 inclusively.

To commence and complete wrapping a pallet of goods 1 with the provided invention in its preferred embodiment the wrap film is drawn from the apparatus' dispensing carriage 2 when set at its lowest height sufficiently to typically tie the wrap film to the pallet 3. The apparatus is then wheeled forward 4 parallel 5 along each side of the pallet by the apparatus control handle 6. During the apparatus' travel around the goods being wrapped, a guide roller 7 mounted on the front left corner of the apparatus' rolling base 8 is steered toward the subsequent pallet corner 9.

FIG. 1. & FIG. 2.2

The guide roller, at the approximate height of the pallets' edge is aimed toward the far side of each pallet corner 9 or any immovable point that a load contacts the ground.

This is a point, from which leverage can be obtained that is realised via further pivoting travel of the apparatus around the pallet corner 10 with the wrap roll brake 11 squeezed underneath the control handle 6 to stop the unrolling of the wrap film which will then be increasingly stretched between the dispensing carriage of the apparatus pivoting away from the goods 10 and the last point the film was in contact with the goods 12 being wrapped on the stationary pallet.

FIG. 2.3

Once the apparatus has pivoted approximately ninety degrees around a pallet corner 14 and subsequently aimed toward the following pallet corner, it can be wheeled forward 15 which immediately places the tensioned wrap film in contact with the goods 16 which adheres there by the tensioned clinging properties of the film:

At this point the wrap roll brake 11 can be released until the following corner of the pallet or a similar immovable point of a load is approached and around which the pivoting, tensioning leverage and forward travel can be repeated.

FIG. 2.4 After completing the first encircling action with the apparatus to dispense the wrap film around the pallet of goods 17 in the expected upward spiraling revolutions, the dispensing carriage 2 is able to be raised to the subsequent level of wrapping required.

Prior to raising the wrapping height of the dispensing carriage 2 a length of wrap film is drawn from the dispensing carriage and slackened 20 by steering the apparatus away 21 from and then back towards the goods being wrapped.

This allows raising the. dispensing carriage without impeding progress by unintentionally stretching upward the previously dispensed length of wrap film 20.

The dispensing carriage 2 is then raised and lowered via either of the two height Control handles 17.1 & 17.2.

When either lifting cable end attached height control handles 17.1 or 17.2 are pulled downward along either of the right 18 and front middle 19 vertical frame tubes, the dispensing carriage 2 suspended mid way along said lifting cable ascends at half the speed that either height control handles are pulled downward due to the 2:1 ratio of the lifting cable passing around the central dispensing carriage attached pulley.

Once the resulting wrap height has been attained via adjustment of the height control handles then the guide roller 7 on the apparatus' base is again guided toward and around the following corner of the pallet 22 being the leverage point around which to leverage tension to the previous wrap revolution. During the described encircling and height increased dispensing' and tensioning of the wrap film repetition until the wrapping around the goods to be wrapped are equalled or exceeded in height, a second wrap roll brake that is incorporated upon the dispensing carriage at the bottom end of the wrap roll 23 provides an easier accessed ergonomic control over stopping the wrap film unrolling when the dispensing carriage is at such an increased height as to place the upper wrap roll brake 11 in an awkward or out of reach place to be effectively operated. The previously described wrapping process without commencing by tying of the wrap to the pallet can be repeated at height with the alternative of using the lower wrap roll brake 23 instead of the upper wrap roll brake 11.

FIG. 2.5

To conclude the wrapping process the wrap film is tensioned around the last corner of the pallet of goods 24 and the apparatus is positioned to have the full wrap film width press against a slotted cutter tube 25 incorporated upon the dispensing carriage 2 during manufacture.

FIG. 2.6

The cutter blade 27 is mounted ˉbetween two rod billets, one of which is on file outside 28 of the slotted cutter tube 25 and the other of which is within the slotted cutter tube 29 and they are able to slide up and down 26 along said slotted cutter tube 25 with the upward facing cutter blade exposed edge 27 between them and passing through said slot in the slotted cutter tube. The cutter is raised along the slotted Cutter tube by pulling upward on a knurled knob 30 at the top of the Slotted cutter tube that is attached via cable 31 to said cutter and billet rod assembly. With the tensioned wrap film positioned flat against the slot 25 in the cutter tube the blade 27 of the cutter ascends along the slot and as such slices through the wrap film 32.

The film that is on the wrapped goods side of the cutter falls or is pressed against and adheres to the film wrapped around the goods on the pallet and the film end that is on the wrap roll side of the cutter is held between a vertical roller 33 around which the film exits the dispensing carriage and an. incorporated strip of rubber 34 in pressure contact with said roller upon the carriage to Create a pinch point 35 between which a short length of wrap film 36 is sandwiched for immediate retrieval when next commencing to wrap other goods.

FIG. 3 Assembly and Functions of Apparatus Dispensing Carriage/Upper Wrap Roll Brake/End Keeper and Lower Brake Handle.

The dispensing carriage 2 comprises of a horizontal top plate 37 and bottom plate 39 supporting several functions and vertical connecting sections with relative functions. The top plate 37 supports the main control handle 40 incorporating a fixed wrap roll brake prong 42 and within said control handle a hand operated pivoting wrap roll brake lever 44 and an integrated opposing second brake prong 46.

The top plate also incorporates a balanced lifting point, 48 a cutter tube upper support bracket, 50 and a hole to affix a bearing mount 52 for a vertical wrap width roller tube 54 around which the wrap film is dispensed.

The bottom plate of the dispensing carriage possesses a corresponding hole to affix a bearing mount bolt 56 to support said vertical wrap width roller tube, a lower cutter tube support bracket 58, a wrap roll core support hub 60 over and around which the lower end of the typical wrap roll cardboard core 62 is placed and two holes 64 at one end of the downward folded sides of the bottom plate 37 as pivot points for a lower wrap roll brake 66.

Between the top and bottom dispensing "carriage plates is a carriage main tube or channel 68, a connecting tube between the balanced lifting point of the upper and lower carriage plates 70, a front left vertical angle 72, a curer tube 74 incorporated between the upper cutter tube bracket 50 and lower cutter tubebracket 58 mounted on the dispensing carriage top and bottom plates respectively.

The carriage main tube or channel 68 through which the left hand apparatus frame tube 76 is inserted during apparatus assembly is most rigid and fundamental to the dispensing carriage construction.

The connecting tube 70 at the balanced lifting point 48 of the top and bottom plates contains a threaded nut into which a lifting eyebolt 71 and or a pulley can be directly fastened.

The front left angle 78 of the carriage onto which a strip of metal 80 is fastened and under said metal strip is fastened the left vertical edge of a 50 mm or suitably wide strip of rubber 82, the right vertical edge of which is curved toward and wipes against a vertical wrap width roller tube 54 providing a flexible pinch point 84, between which the wrap film 86 is passed on way to wrapping the goods and that also sandwiches and accessibly retains the loose wrap film end 86 after being cut by the wrap cutter 88.

The vertical wrap width roller tube 54 has a bearing inserted and retained top and bottom 90 and is mounted onto the dispensing carriage between a bearing mounting bolt descending through a hole in the top plate 52 and a corresponding bearing mount bolt ascending from a corresponding hole 56 through the lower plate of the dispensing carriage.

The wrap cutter tube 74 is held between the upper and lower cutter tube support brackets 50 & 58 incorporated onto the top and bottom plates 37 & 39, respectively, of the dispensing carriage 2.

FIG. 4 Apparatus Upper Wrap Roll Brake Handle.

Descending below the main control handle 40 that is supported on the dispensing carriage top plate 46 is the stationary one of two wrap roll brake prongs 42. The second brake prong 46 is incorporated onto the brake lever 44 that pivots within the control handle 40.

When the brake lever is squeezed 92 within the control handle by the operator's hand, the brake prongs expand 94 inside the top end of the wrap roll cardboard core 96 into which they protrude downward when the roll is correctly mounted 98 up around said brake prongs and downward and around the wrap roll hub 60 on the lower plate of the dispensing carriage 39. Expansion of the brake prongs 42 & 46 within the wrap role core 96 slows or stops the unrolling motion of the wrap film being drawn off of the roll when wrap tensioning is required. The feel of the tension achieved relative to the squeezing 92 of the brake lever 44 and leverage of the apparatus around the load provides the operator information to judge adequate tensioning of the wrap.

FIG. 5 Apparatus Lower Wrap Roll Brake Handle

Assembled onto the bottom dispensing carriage plate 100 is a lower wrap roll brake handle 102 as an alternative to the upper wrap roll brake handle when the wrapping procedure ascends high enough to be uncomfortable to slow or stop the wrap roll with the upper brake handle due to the wrapping revolutions around a load nearing or exceeding an operator's shoulder height, The lower wrap roll brake handle 102 comprises a bent piece of metal one end of which forms a handle at a horizontal position 103 and the other end is upwardly bent 104 through an opening in the lower carriage plate and within a short cylindrical shaped protrusion incorporated during manufacture that forms the wrap roll support hub 105 over and around which the wrap roll cardboard core is placed when correctly installed. The lower brake handle pivots on an axle 106 affixed to the lower wrap roll brake handle 102 during manufacture and that each end of said axle 106 extends through two holes 107 & 108 incorporated into downward bent edges 109 of the lower carriage plate in order to provide a fulcrum 110.

FIG. 6 Lower Wrap Roll Brake Handle Operation.

By exerting downward pressure 111 on the lower wrap roll brake handle 102 via said fulcrum causes the upwardly bent section of the handle to move sideways 112 toward which it applies contact pressure 113 to the inside of the lower end of the cardboard core 114 of a wrap roll when said core is positioned correctly onto the dispensing carriage wrap roll support hub 105.

Use of this lower wrap roll brake handle causes the unwinding action of film being drawn off of the roll to slow or stop for then the pivoting action of the dispensing carriage to occur around the guide roller in contact with the far side of a corner of a pallet being wrapped during the wrapping process affording stretching tension of the wrap at an increased though ergonomic height.

FIG. 7. Apparatus Wrap Film Cutter and Wrap Film End Keeper.

A wrap film cutter is included on the apparatus as a means of cutting through the wrap film at completion of the wrapping task. In its preferred embodiment, it comprises of a blade in the shape of a slant parallelogram 27 that is mounted with a sharpened cutting edge facing upward and slanting towards the slot in the cutter tube in which it is partially housed and operates to influence a shearing action to the wrap film.

The safety cutter blade 27 is mounted between two rod billets, one of which is on the outside 28 of the slotted cutter tube 25 and the other of which is within the cutter tube 29 and they are able to slide up and down 26 along said slotted cutter tube 25 with the upward facing cutter blade exposed edge 27 between them. The cutter is raised along the cutter tube by pulling upward on a knurled knob 30 at the top of the cutter tube that is attached via thin cable 31 to said cutter assembly. With the tensioned wrap film positioned flat against the slot 25 in the cutter tube, the cutting blade 27 ascends along the slot to slice through the wrap film 32. The distance between the rod billet 28 mounted on said cutter blade 27 on the outside of the cutter tube has space enough for the film to pass between it and against the cutter tube but not enough space to allow fingers to touch the blade 27.

The film once cut that is on the wrapped goods side of the cutter falls or is pressed against and adheres to the film wrapped around the goods on the pallet and the film end that is on the wrap roll side of the cutter is held between a vertical roller 33 around which the film exits the dispensing carriage and an incorporated strip of rubber 34 in pressure contact with said roller upon the carriage to create a pinch point 35 between which a short length of wrap film 36 is sandwiched for immediate retrieval to commence wrapping other goods. The cutter then descends within the cutter tube when lowered by said cable connected knurled knob.

FIG. 8 Apparatus Height Control Handles and Support Cable

The means for supporting the dispensing Carriage 120, at an adjustable height along the left square Rolled Hollow Section RHS frame tube 122 along which the dispensing carriage travels vertically, is permitted by a lifting cable attached to two height control handles 124 & 126. The two height control handles 124 & 126 are positioned along the square RHS apparatus frame tubes 128, 130 that are set to the front middle and right of frame tube 122.

A lifting cable 132 is affixed to the first or nearest of height control handles 124 and threaded up and over a first pully 134 fixed upon the frame via a hook 136 incorporated during manufacture. The cable is then guided horizontally toward a second pully 138 that is fixed to one of a pair of pulley hooks 140 incorporated upon the frame cross tube 142 during manufacture that is substantially over the top of a lift point 144 provided upon the top of the dispensing carriage 120 directly below said pair of pulley hooks 140.

The cable is then directed downward to and through a third pulley 146 fixed to the lift point 144 on top of the apparatus' dispensing carriage 120 from which it is then directed upward toward and through a fourth pulley 148 being the other of the pair of pulleys fixed to the pair of hooks 140 mounted on the apparatus frame cross tube 142 during manufacture.

The lifting cable 132 is threaded from the fourth pulley 148 and across toward a fifth pulley 150 fixed to a hook 152 which is incorporated during manufacture under a shorter forward facing cross tube 154 which attaches the front middle frame tube 156 of the apparatus' three frame tubes to the apparatus main cross tube 142.

The cable is directed downward from the fifth pulley 150 toward the second and forward most height control handle 126 mounted along the front middle, frame tube 156.

Both height control handles 124 & 126 raise and lower the lifting cable 132 either side of the dispensing carriage middle pulley 146 which is affixed to the balanced lifting point 144 of the carriage 120. The cable doubles back around this pulley when pulled downward at either of the height control handles 124 & 126 lifting the dispensing carriage affixed pulley at half the speed =50% that either handle is pulled downward =100% and therefore via typical block and tackle operation at the ratio of 2:1 the weight of the dispensing carriage and wrap roll film is halved when realised at either height control handle by single hand downward pulling effort.

The cable selected to connect height control handles that lift the dispensing carriage in the preferred embodiment is of a non-injurious plastic-coated type that is safe to the touch and large enough to suspend the weight of the dispensing carriage and full wrap roll.

FIG. 9.1 Each height control handle consists of a flat plate with an operative handle grasp 160 which extends from a broader section 162 of the handle that includes a square hole 164 incorporated during manufacture that is of slightly greater dimension to the square frame tube 165 over and along which it is to slide and remain at the same orientation at which the frame tubes are set.

FIG. 9.2 Each height control handle can move freely along the vertical frame tube when either handle is held horizontally 166 but can not move if angled either upward 168 or downward 170 from horizontal.

Essentially a simple description of such repositionable locking means is a tent rope adjuster peg which binds along the rope on which it is able to slide when tension on said adjuster that is offset from said rope causes the adjuster peg to be angled and thus binds on the rope passing through a hole in the adjuster peg.

Either of the apparatus height control handles rigidly locks against the frame tube if angled 168 and remains locked even with increased forceful attempt to move it further.

FIG. 9.3 To ensure the height control handles can move in a desired manner when being repositioned under load they each have two projections incorporated during manufacture each resembling a book end 172 including left and right sides 174 & 176.

FIGS. 9.2 & 9.3 Two said projections are attached to each height control handle, one above and behind 178 the square hole 164 within said handle with the inside central face of the book end like projection 180 positioned to slide flat against the back 178 of the frame tube 165 as well as another projection attached below and in front 182 of the square hole 164 within said height control handle with the inside central face of the book end like projection 180 positioned to slide flat against the front 182 of the frame tube 165. The said projections do not permit the height control handle to be angled lower than horizontal 184 when travelling downward along the right or middle front frame tubes but do allow each handle to angle upward above horizontal 186 to prevent ascent along said frame tubes due to said locking action.

FIG. 9.4 The sides of the book-end like projections 174 & 176 also prevent the height control handles from tilting left to right as this would also cause the height control handles' square hole 164 to lock onto the frame tubes along which they slide.

FIG. 10 Apparatus lifting Cable and operation of locking height control handles. Each end of the lifting cable that is threaded via the dispensing carriage central pulley 190, connects to each height control handle 192 at an offset point from the centre line of the frame tubes 194 & 196 along which they travel which ensures a binding, upward from horizontal influence 186 on the height control handles 197 & 198 due to the downward weight of the dispensing carriage lifting pulley 190 on the lifting cable via the above positioned pulleys 100, 102, 104, & 106 and as the height control handles are angled upward 168 when pulled by the cable they both lock onto the frame tubes wherever the height control handles are repositioned along the right and front middle frame tubes 194 & 196 along which they travel.

When hand pressure is exerted downward onto the height control handles enough to overcome half the weight at the dispensing carriage lifting pulley 190, the handles unlock from the position on the frame tubes 194 & 196. Any further pressure applied downward slides the height control handle downward which lifts the dispensing carriage lifting pulley 190 via the lifting cable and pulleys until the desired height is attained at which point the height control handle can be released to instantly allow the change of angle of the handle upward from horizontal 186 to lock onto the frame tubes 194 & 196 at a different position.

To lower the dispensing carriage, hand pressure is exerted downward 184 onto the height control handle enough to level it to horizontal 166 which defeats the height control handle's lock 172 onto the respective frame tube 194 & 196. At this moment a reduction in hand pressure allows the upward force of the dispensing carriage attached lifting cable 192 to pull the height control handle upward as long as the hand pressure on the handle is enough to keep the handle horizontal but not enough to stop upward travel of the handle nor enough to push the handle downward.

The dispensing carriage via its attached central pulley 190 will descend along the left frame tube 163 as either height control handle 196, 198 is allowed to ascend on the right or front middle frame tubes 194 & 196 until either handle 197 or 198 is released or allowed to angle above horizontal which instantly locks the handle onto the respective frame tube.

The book end type projections 178 & 182 eliminate binding of the height control handles on the frame tubes when being pushed downward 184 to subsequently lift the dispensing carriage lifting pulley 190 as well as a reference of horizontal which is felt by the operator when ascending the height control handle and thus descending the dispensing carriage along the left frame tube 163.

Referring to FIG. 11, the base for the apparatus in its preferred embodiment comprises of steel cross braces and components with holes and bends incorporated during manufacture for the purpose of function, assembly and durability.

The left base metal component 200 commences as a horizontal flat section 202, is then angled downward 204, then horizontally flat 206, then angled upward 208 and then horizontally flat 210 at the same height as the first section.

The first and last flat horizontal sections are for wheels to be mounted underneath 112 & 114 and the lower middle section 206 between the two downward angled sections contains a hole 216 through which to fasten the left hand side dispenser carriage frame tube 218.

The lower middle section 206 of the left base component 200 allows the dispenser carriage to descend to almost ground level along the said fastened left frame tube 218 to allow the wrap to be dispensed at a lowest possible convenience around the goods to be wrapped.

Front and rear cross braces 220 & 222 connect the left side component 200 of the base to the right side component 224 of the base. Along the right side component there are two holes 226 & 228 through which to fasten the right 230 and middle front 232 apparatus frame tubes. Below said right side component are mounted two wheels 234 & 236 of same size to those of the left side.

Mounted on the base front left corner is a soft guide roller 238 that rolls along the side of the pallet or goods positioned on or overhanging the edge of a pallet and that also provides a non-damaging contact point around which to generate pivoting leverage when achieving wrap film tensioning through the use of the provided invention.

The base in its preferred embodiment includes wheels that are not so tall to position the height of the apparatus guide roller above the edge of a typical pallet to be wrapped.

Larger wheels may be affixed to allow for a non typical application while reduced rolling resistance around a load my also afford function on irregular ground surfaces.

Still referring to FIG. 11, the frame comprises of three, left 240, front middle 242 and right 244, vertical, square RHS Rolled Hollow Section steel tubes; another of the same steel section across the top of the left 240 and right 244 vertical tubes and a shorter brace tube 248 of the same section tube adjoining the front middle 242 vertical tube to said cross tube 246, set to the front side of the cross tube 244 and forward enough from said cross tube to brace the frame substantially vertical via the tripod effect of their combined footprint upon the base 150.

The frame has four hooks incorporated during manufacture that support pulleys associated to the apparatus function.

The lower ends of the frame tubes include internal fastening means incorporated during manufacture that affix the frame to the base to allow assembly and disassembly for reduced volume in transit and storage.

The frame has welded as well as bolted joints to afford durability and assembly convenience where applicable. The material in the preferred embodiment is galvanised steel for durability and longevity in open air use.

The invention claimed is:

1. A wrapping apparatus for dispensing a wrapping material to wrap an object, said apparatus comprising:

a base having one or more movable elements allowing movement of the apparatus from one location to another location during wrapping of the object, a frame arrangement including a first frame member attached to the base and extending upwardly from the base, a second frame member attached to the base and extending upwardly from the base, and a third frame member attached to the base and extending upwardly from the base, a dispensing carriage for supporting a supply of wrapping material mounted to the first frame member, said dispensing carriage being vertically movable with respect to the first frame member to alter the height of the dispensing carriage, a height control assembly including a cable having a first end, a second end and an intermediate portion defined therebetween, wherein the first end is slidably connected to the second frame member, the second end is slidably connected to the third frame member and the intermediate portion is slidably connected to the dispensing carriage to raise and lower the dispensing carriage when the first end or the second end is adjusted along its respective frame member, and a guide element incorporated as a leverage-providing rolling pivot point connected to the base for providing intermittent, discretionary contact with a part of the object being wrapped to assist in deriving leverage and controlling tensioned movement of the wrapping apparatus when moving from a first location to a second location in a 90 degree arc, wherein when the guide element pivot point contacts part of the object, the wrapping apparatus is able to move around the pivot point in contact with the object to allow the wrapping material to be applied to the object and to be tensioned by way of leverage thereby wrapping the object.

2. A wrapping apparatus of claim 1 in which the movable element of the base is one or more wheels, rollers, skids, or other element permitting movement of the wrapping apparatus over a supporting surface.

3. A wrapping apparatus according to claim 2 in which the movable element includes four wheels connected to the base for permitting movement of the wrapping apparatus about the guide element.

4. A wrapping apparatus according to claim 1 in which the base includes at least one support member in which the support member is generally bent, having a plurality of individual sections arranged with respect to one another including three sections in aligned substantially parallel relationship to one another alternately arranged with two inclined portions to form a well structure.

5. A wrapping dispensing apparatus according to claim 4 in which a first of the parallel sections is a central section located intermediate the two inclined sections which extend in opposite directions to one another, and the other two parallel sections are each end sections wherein a castor wheel is pivotally connected to each of the two end sections to support the wrapping apparatus.

6. A wrapping apparatus according to claim 1 in which there are three framework members extending from the base in which two of the framework members are located in spaced apart relationship to one another along one side or edge of the base and a single framework member is located along the opposite edge or side of the base.

7. A wrapping apparatus according to claim 1 further comprising a control interface for executing control of movement of and operable functions of the wrapping apparatus when in use, including maneuvering the wrapping apparatus to contact the object.

8. A wrapping apparatus according to claim 7 in which the control interface is a fixed control member mounted on the dispensing carriage for controlling movement of the wrapping apparatus during use, including movement to apply tension to the wrapping material.

9. A wrapping apparatus according to claim 1 in which the guide element is located at or towards one corner, side or edge of the base of the wrapping apparatus.

10. A wrapping apparatus according to claim 9 in which the guide element is connected to an end section of a bent support member of the base so as to extend outwardly from the base, preferably angularly inclined to the lengthwise extending direction of the bent support member.

11. A wrapping apparatus according to claim 1 in which the guide element is mounted on the front or leading left corner of the base with respect to the normal direction of travel when the wrapping apparatus is being used to apply and/or tension the wrapping material to the object.

12. A wrapping apparatus according to claim 1 in which the guide element is a guide wheel, a guide roller, a guide skid, a guide rail, a curved or arcuate buffer rail or similar for movement along or over a surface of the object during wrapping of the object.

13. A wrapping apparatus according to claim 1 in which during wrapping of the object, the guide element remains in contact with the object such that the guide element acts as a fulcrum to facilitate the wrapping apparatus applying tension to the wrapping material.

14. A wrapping apparatus according to claim 1 in which the wrapping apparatus pivots about the object so as to alter the location of the wrapping apparatus with respect to the object to apply wrapping material to the object and to apply tension to the wrapping material due to the pivoting movement of the wrapping apparatus.

15. A dispensing apparatus according to claim 14 in which the guide element moves with respect to the object as the wrapping apparatus pivots about the guide element to facilitate the wrapping apparatus applying leverage to the wrapping material to apply tension to the wrapping material.

16. A wrapping apparatus according to claim 13 in which a fixed main control member is associated with a second control member located in close proximity to the main control member preferably located within a main control handle.

17. A wrapping apparatus according to claim 16 in which the main control handle is an upper control handle located at or towards the top of the dispensing carriage for use in maneuvering the wrapping dispensing apparatus from one location to another location.

18. A wrapping apparatus according to claim 16 in which the second control member is an upper brake handle for applying a retarding force to the supply of wrapping material being dispensed from the dispensing carriage.

19. A wrapping apparatus according to claim 1 in which the supply of wrapping material is a roll of wrapping film mounted for movement on the dispensing carriage.

20. A wrapping apparatus according to claim 19 in which the wrapping film is a stretch film, and the roll of film is mounted at any angle to the carriage dispenser, preferably mounted substantially vertically.

21. A wrapping apparatus according to claim 16 in which the second control member is a lower brake handle located at or towards the lower portion of the dispensing carriage for engagement with the lower end of the supply of wrapping material.

22. A wrapping apparatus according to claim 1 in which the object is a plurality of individual objects which require wrapping to form a unitized load in which the individual objects are bound together by turns of the wrapping material.

23. A wrapping apparatus according to claim 1 in which the object is a pallet having a load of individual objects arranged in stacked relationship or is a load located directly on the ground or floor or similar surface.

24. A wrapping apparatus according to claim 20 further comprising a secondary roller for controlling dispensing of the wrapping film from the roll of wrapping film.

25. A wrapping apparatus according claim 1 in which the dispensing carriage is provided with a movable cutter for cutting, severing or separating the wrapping material to separate the supply of wrapping material remaining on the roll from the wrapping material applied to the object.

26. A wrapping apparatus according to claim 24 in which the dispensing carriage further includes a dispensing carriage roller and contact strip for retaining a severed end of the wrapping material on the dispensing carriage in which the retained end of the wrapping material is sufficient to be grasped and drawn from the dispensing carriage to attach or tie the wrapping material to the object.

27. A wrapping apparatus according to claim 1 in which the guide element is a horizontally arranged rotatable soft guide roller mounted forward left on the base having a substantially vertical axis of rotation.

28. A wrapping apparatus according to claim 1 in which the guide element is located at a height such that the guide element is able to contact the side of the object when located on the ground or floor upon which the wrapping apparatus is located.

29. A wrapping apparatus according to claim 1 in which the second control handle further includes a brake prong and brake lever handle such that movement of the brake lever handle causes corresponding movement of the brake prong to bear against an inside surface of a central core of a roll of wrapping material to retard movement of the roll.

30. A wrapping apparatus according to claim 1 further comprising pivoting the dispensing apparatus around the guide element in contact with the object with a roll brake of the dispensing carriage activated to stop unrolling of the wrapping material thereby applying tension to stretch the wrapping materials between the dispensing carriage of the apparatus and the last point the wrapping material was in contact with the object being wrapped as the apparatus pivots away from the object.

31. A wrapping apparatus according to claim 1 further comprising a cutter blade in which the cutter blade is mounted between two rod billets, one of which is on the outside of a slotted cutter tube and the other of which is located on the inside of the slotted cutter tube, both billets being connected to the cutter blade that passes through and runs along the slot in the cutter tube when pulled along said slot by a cutter moving interface.

32. A wrapping apparatus for dispensing a wrapping material to wrap an object, said apparatus comprising:

a base having one or more movable elements allowing movement of the apparatus from one location to another location during wrapping of the object, a frame arrangement including at least one frame member extending from the base, a dispensing carriage for supporting a supply of wrapping material mounted on or to the at least one frame member, said dispensing carriage being movable with respect to the framework member to alter the location at which the wrapping material is dispensed from the dispensing carriage to wrap the object, at least one height adjustment member for selectively adjusting the position of the dispensing carriage, said height adjustable member cooperatively associated with at least one frame member extending from the base wherein the height adjustable member is movable between a locked position for maintaining the height of the dispensing carriage at a selected height and a release position allowing adjustable movement of the dispensing carriage, and wherein each height adjustment member comprises a body portion having an aperture and a handle extending outwardly from the body portion wherein the frame member is received through the aperture when the height adjustable member is located on the frame member and movement of the handle moves the height adjustment member between the lock position and the release position, and wherein each channel element is provided with a long side, an open side, and two opposed truncated sides in which the long side contacts the framework member in a lengthwise extending direction of the framework member and the open side permits the height control member to pivot about the aperture provided in the body, and a guide element connected to the base for contact with a part of the object being wrapped to assist in controlling movement of the wrapping apparatus when moving from one location to another location wherein when the guide element contacts part of the object, the wrapping apparatus is able to move around the object to allow the wrapping material to be applied to the object and to be tensioned thereby wrapping the object.

33. A wrapping apparatus according to claim 32 in which when the height adjustment member is in the lock position, the long side of the open channel element is arranged to be spaced apart from and angularly inclined to the lengthwise extending side of the frame member to prevent movement of the dispensing carriage and when the height adjustable member is in the release position, the long side of the open channel is substantially parallel to a side surface of the frame member to be in contact with the frame member approximating the aperture in said adjustment member to be horizontal and open around said frame member thereby allowing sliding movement of the height adjustable member in the lengthwise extending direction of the framework member to adjust the height of the dispensing carriage.

34. A wrapping apparatus according to claim 32 in which the height adjustable member is free to pivot in a first pair of two diagonally opposed quadrants but is prevented from moving in a second pair of diagonally opposed quadrants, the first pair of quadrants being different from the second pair of quadrants.

35. A wrapping apparatus for dispensing a wrapping material to wrap an object, said apparatus comprising:

a base having one or more movable elements allowing movement of the apparatus from one location to another location during wrapping of the object, a frame arrangement including a first frame member attached to the base and extending upwardly from the base, a second frame member attached to the base and extending upwardly from the base, and a third frame member attached to the base and extending upwardly from the base, a dispensing carriage for supporting a supply of wrapping material mounted to the first frame member, said dispensing carriage being vertically movable with respect to the first frame member to alter the height of the dispensing carriage, a height control assembly including a cable having a first end, a second end and an intermediate portion defined therebetween, wherein the first end is slidably connected to the second frame member, the second end is slidably connected to the third frame member and the intermediate portion is slidably connected to the dispensing carriage to raise and lower the dispensing carriage when the first end or second end is adjusted along its respective frame member, and a guide element rigidly connected to the base such that the guide element maintains a fixed spatial relationship with respect to the base, the guide element configured to contact with a part of the object being wrapped to assist in controlling movement of the wrapping apparatus when moving from one location to another location, wherein when the guide element contacts part of the object, the wrapping apparatus is able to move around the object to allow the wrapping material to be applied to the object and to be tensioned thereby wrapping the object.

* * * * *